US005249739A

United States Patent [19]

Bartels et al.

[11] Patent Number: 5,249,739

[45] Date of Patent: Oct. 5, 1993

[54] APPARATUS AND METHOD FOR MONITORING THE OPERATING CONDITION OF A BURNER SYSTEM

[75] Inventors: James I. Bartels, St. Croix County, Wis.; Anil K. Gowda, Hennepin County, Minn.; Timothy F. McCarthy, Hennepin County, Minn.; Donald W. Moore, Dakota County, Minn.

[73] Assignee: Honeywell Inc., Minneapolis, Minn.

[21] Appl. No.: 863,601

[22] Filed: Apr. 3, 1992

[51] Int. Cl.[5] ..... F23N 11/00

[52] U.S. Cl. ..... 236/15 BR; 236/15 C; 431/12; 431/78

[58] Field of Search ..... 236/14, 15 R, 15 C, 236/15 BD, 15 BG, 15 BR; 431/12, 75, 78

[56] References Cited

U.S. PATENT DOCUMENTS 3,877,636 4/1975 Sato ..... 236/14
4,373,663 2/1983 Hammer .
4,375,950 3/1983 Durley ..... 236/15 BD
4,606,529 8/1986 Tooch .
4,994,959 2/1991 Ovenden et al. .

*Primary Examiner*—Carroll B. Dority
*Attorney, Agent, or Firm*—Edward Schwarz

[57] ABSTRACT

Apparatus and method for sensing the operating condition of a burner system relies on flue temperature as the indicating variable. When the operating status is stable, the flue temperature should be nearly identical to that when the system was known to be in proper condition. During a time when the system is known to be in proper operating condition, the flue temperature is recorded during stable operation for a number of different firing rates. When identical or similar firing rates occur at a later time and operation is stable, the operating flue temperature is compared with the current flue temperature, and if substantially different, an operation status signal is set to a state indicating this change in operating condition.

19 Claims, 6 Drawing Sheets

APPARATUS AND METHOD FOR MONITORING THE OPERATING CONDITION OF A BURNER SYSTEM

BACKGROUND OF THE INVENTION

With the increasing cheapness and reliability of microprocessors, it is natural to use them for the control of many complex systems which must be controlled with high precision and with rigorous standards of reliability. The microprocessor may be embedded within the overall system, or it may be part of a stand-alone PC (personal computer) system such as is commonly available from a variety of sources. Among such systems are burner systems such as are used in boiler and heating systems and it is for such systems that the following disclosure is directed.

Once the change to microprocessor control has been implemented, it is relatively easy to add further functions of all types which improve the reliability, maintainability, efficiency, and flexibility of the system. By adding the appropriate sensors, it is also possible to monitor the operating status and by detecting slight changes in the operation, perhaps even perhaps even the approximate time when efficiency will fall below an acceptable level. This allows dealing with such problems during scheduled maintenance when the impact in terms of cost and convenience is least. It also allows maintenance to be deferred until actually cost effective, and then promptly performed.

Among the important considerations in the operation of a burner system is fuel efficiency. There are many different possible methods by which fuel efficiency may be sensed. For example, the efficiency may be determined more or less directly by sensing the change in heat energy contained by the fluid to which heat is transferred. Such a system requires measurement of flow rates and temperatures of the fluid to which heat is transferred, as well as the fuel flow rate. There is potential for errors in these measurements which can affect the accuracy with which the efficiency is determined. Since efficiency changes with firing rate and varies from one to another installation, simply calculating thermal efficiency for a given firing rate does not clearly indicate whether the burner is operating at the optimal efficiency for the operating state.

One can also analyze the constituents of the escaping flue gasses in measuring the fuel efficiency. However, each of the individual analyses is difficult, slow, and expensive. Accordingly, this approach does not lend itself to microprocessor implementation. An example of this approach is described in U.S. Pat. No. 4,994,959 (Ovenden, et al.), which teaches a burner control system where the fuel-air ratio is controlled on the basis of the amount of oxygen in the exhaust gasses. A stored table of preferred oxygen concentrations for different firing rates is used to control the air flow to the burner. The entries in the stored table are determined empirically. The purpose of this feature of the control system is to adjust the combustion process for maximum efficiency.

U.S. Pat. No. 4,373,663 (Hammer) discloses a burner control system which uses as one parameter on which the control algorithm is based the pressure of a working fluid such as water or steam.

BRIEF DESCRIPTION OF THE INVENTION

This invention comprises elements which form a monitoring system for the operation of a burner system. We have determined that a proper comparison of the burner system's flue temperature can provide an accurate indication of any fall of the burner system operation from optimal or maximum efficiency, an indication which we will generally refer to as operating status. The invention described is applicable to both step and continuously modulated burner controls. It is suitable for use on single and multiple burner systems as well. It is compatible with any type of fuel whose flow is controlled to the combustion chamber.

Our invention comprises apparatus for signaling operating status for a burner system including a controller receiving a set point signal and issuing a firing rate signal encoding a firing rate having a value dependent on the set point signal, a combustion chamber, a modulating fuel valve controlling flow rate of fuel to the combustion chamber responsive to the firing rate signal, a heat exchanger, and an exhaust flue in flow communication with the combustion chamber and through which pass combustion gasses from the combustion chamber.

This apparatus includes a temperature sensor mounted within the exhaust flue and providing a flue temperature signal encoding the temperature of combustion gasses within the exhaust flue. Timer means provide a first timing signal defining the beginning and end points of a plurality of first time intervals. Stability detector means receive the firing rate signal and the first timing signal and provide a stability signal having a first state responsive to a change of less than a predetermined amount in the firing rate between the beginning and end points of a first time interval and a second state otherwise.

A temperature table memory records a plurality of flue temperature values each of which are recorded in association with a specified firing rate value. The memory provides a memory output signal encoding the flue temperature value recorded in association with a firing rate value responsive to a read request signal encoding that firing rate value. A table manager means receives the firing rate signal and supplies to the temperature table memory a read request signal encoding the firing rate encoded in the received firing rate signal. This causes the temperature table memory to issue a memory output signal encoding the temperature value associated with the firing rate encoded in the read request signal.

Temperature comparison means receive the flue temperature signal from the temperature sensor and the memory output signal from the temperature table memory and form the difference between the temperatures encoded in the flue temperature signal and the memory output signal. The temperature comparison means supply a comparison signal having a first state responsive to the difference between the temperatures being more than a predetermined amount and a second state otherwise. Operation analysis means receive the stability signal and the comparison signal and when the first state of the stability signal and the first state of the comparison signal both exist, provides an operating status signal having a first state, and if these two conditions do not both exist, an operating status signal having a second state.

The reader should note that the fuel valve may have step modulation, where only a single open state exists.

Multiple burner systems can also use the invention, although the control algorithm must make special provisions to assure that conditions during testing are consistent with the conditions during updating of the temperature table.

Accordingly, one purpose of this invention is to increase efficiency of a burner system.

Another purpose is to sense changes in burner system operation as time passes following initial installation or after an overhaul.

Yet another purpose is to track changes in burner system operation arising from servicing of the burner system or its controls.

BRIEF DESCRIPTION OF THE DRAWINGS

FIG. 3 shows a scheduler identifying the order in which the various modules are executed.

FIG. 4 symbolizes the instructions for setting up operation of the invention after a reset command.

FIG. 5 symbolizes the instructions for building the temperature table and for testing operating status.

FIG. 6 symbolizes the instructions for detecting stability of burner system operation.

FIG. 7 symbolizes the instructions for updating the firing rate table.

DESCRIPTION OF THE PREFERRED EMBODIMENT

Figure 1:
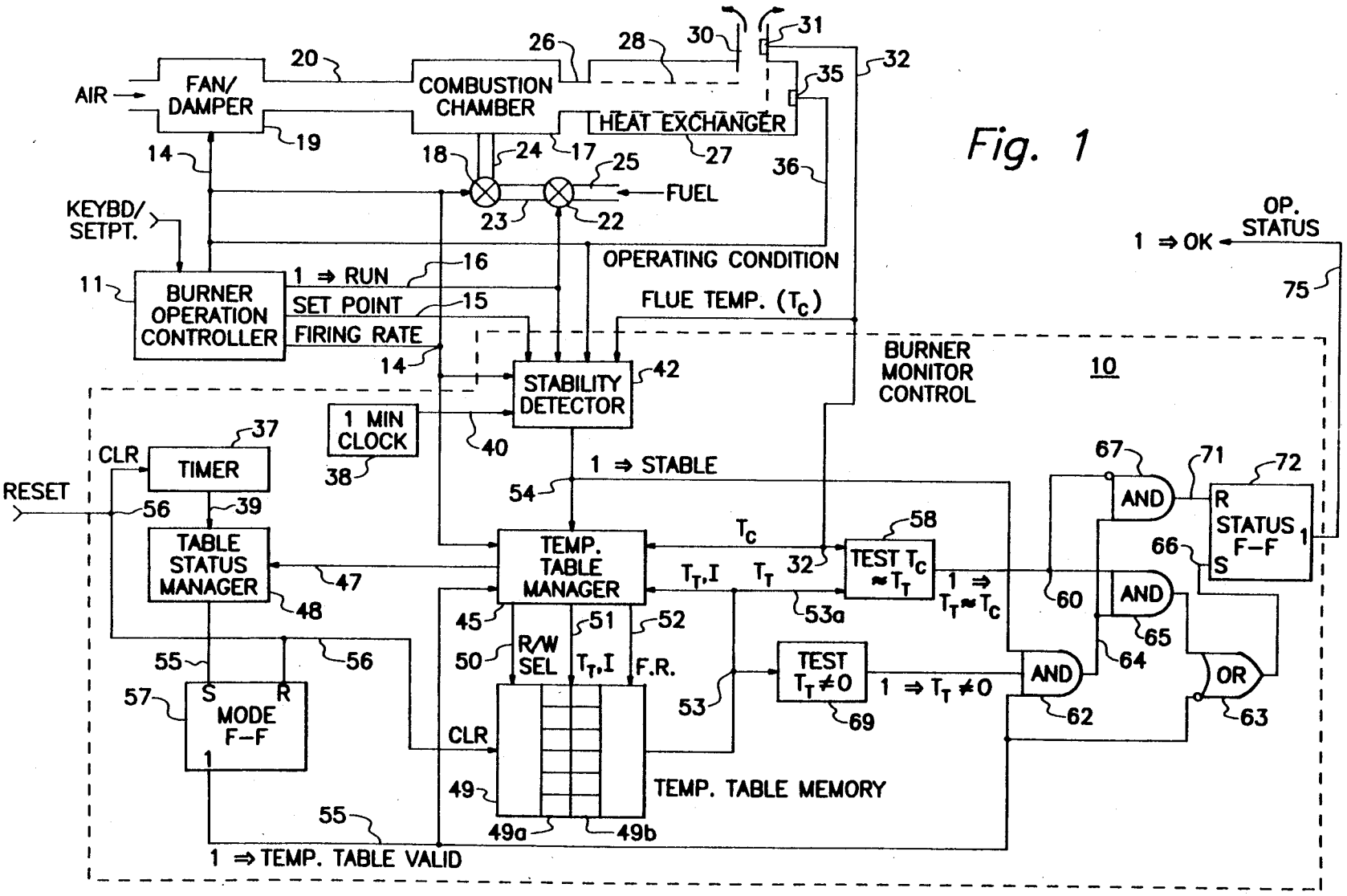
FIG. 1 is a hardware-oriented block diagram of a system implementing the invention.

This invention comprises elements which form a monitoring system for a burner system. At the outset it should be pointed out that the invention's preferred embodiment is a properly programmed microprocessor which comprises burner monitor controller 10. A microprocessor also comprises the burner operation controller 11. In general, the user by loading a properly designed program into the microprocessors comprising controllers 10 and 11, in effect transforms the microprocessors into hardware comprising the functional blocks of FIGS. 1 and 2. It is of course well known that when a microprocessor executes a program, the individual functional elements such as those shown in FIGS. 1 and 2 exist for brief periods of time while the execution of the individual instructions which cause the microprocessor to perform the specified function occurs. Individual signals shown to be carried on paths connecting the individual functional blocks are temporarily stored as data in registers (shown in FIGS. 1 and 2 in only a few instances) internal to controllers 10 and 11 during the interval between completing execution of the instructions for a particular block and starting execution of instructions for a block receiving a signal from the particular block.

There are signals both received from the burner system by controller 11 and transferred to the burner system from the controller 11. In this embodiment controller 10, which comprises the invention, only receives data from the burner system as well as from controller 11. These microprocessor-based controllers 10 and 11 typically have both analog and digital input and output channels by which communication with external devices is conducted. For the discussion following, it is assumed that the actual digital value or state of an input signal from a particular device is available at all times in prearranged operand memory locations of the microprocessor. Signals are provided to an external device by loading the digital representation of the signals in similar prearranged operand memory locations of the microprocessor. Of course, these individual data signals may be accompanied by an associated request signal indicating the presence of the data in the prearranged memory location. No further discussion is necessary of the availability of any of this data to the destination intended, be it an external device or the internal elements of the microprocessor.

The timing of the execution of the individual instruction groups which implement the functions of the individual blocks is inherent from the relative time relationships shown by the signal paths between the various functional blocks. It is not believed that there are any race conditions in FIGS. 1 and 2 which may cause improper operation of a program derived from FIGS. 1 and 2. Even if there are, the person of skill in the art will find it easy to deal with the problems arising in his or her specific implementation of the invention. The sequential mode of operation of stored program microprocessors causes automatic sequencing of the various data or signal generating functions.

Figure 2:
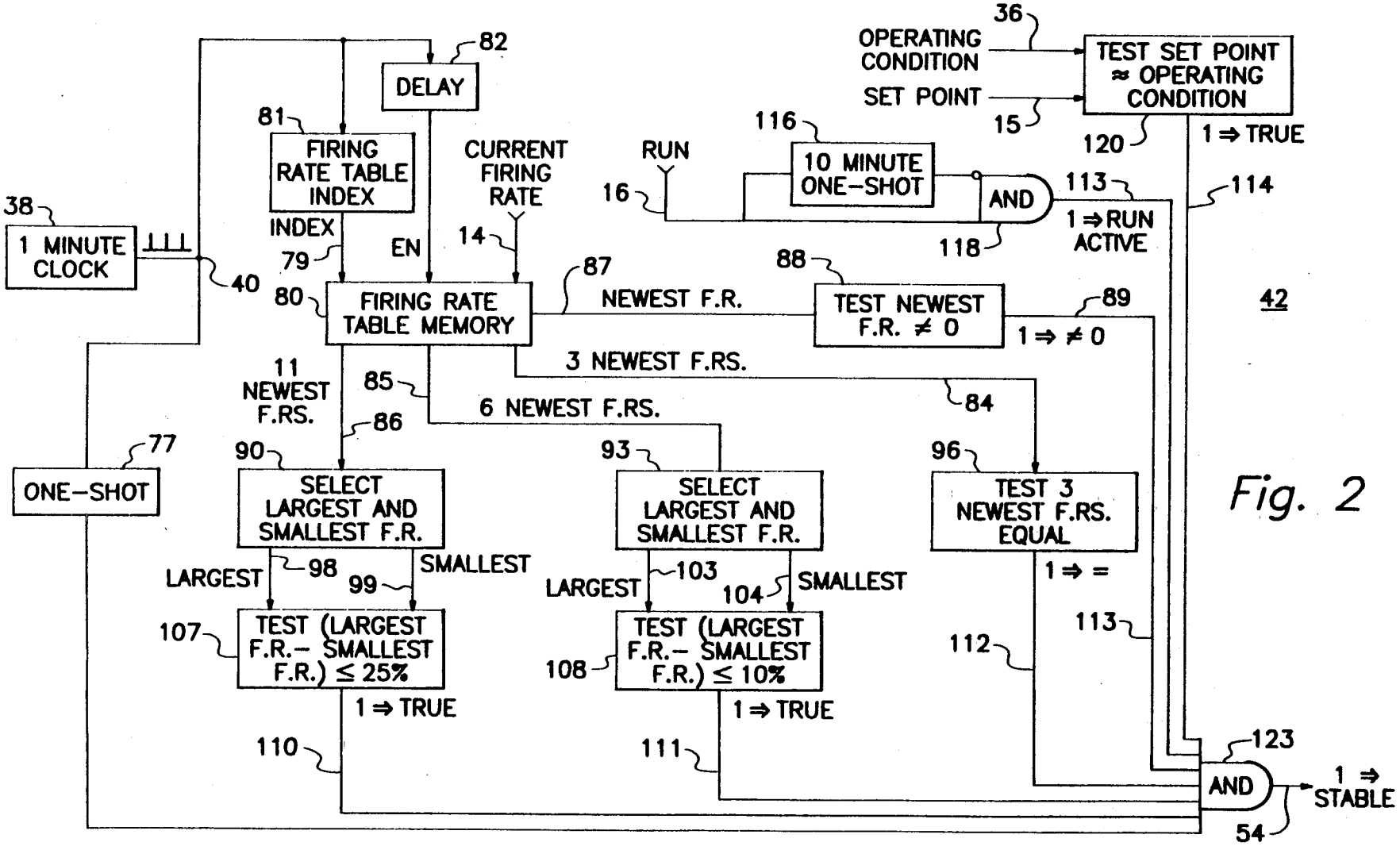
FIG. 2 is a hardware-oriented block diagram detailing the structure of the stability detector of FIG. 1.

A number of the functional blocks in FIGS. 1 and 2 are shown as conventional AND or OR logic gates and are labeled as such. The reader may consider these elements to operate with known principles of Boolean mathematics even though implemented as software within controller 11. A small circle at the input of a logic gate means that the signal received there is given its opposite sense. That is, a logical 0 received at that input is interpreted by the logic gate as being a logical 1, and a logical 1 received at that input is interpreted by the logic gate as being a logical 0. This is conventional practice in logic diagrams.

Turning first to FIG. 1, a microprocessor shown in dotted box outline functions as a monitor controller 11 to perform the monitor operation of this invention. A second microprocessor functions as controller 11 for operating the burner system. The conventional burner system is shown in FIG. 1 as including a fan/damper module 19 into which combustion air is drawn. The volume of air which is drawn into fan/damper 19 is controlled by a firing rate signal carried on a path 14. This combustion air is forced through a duct 20 into a combustion chamber 17.

Fuel is supplied to combustion chamber 17 through a pipe 24. In one kind of burner system, fuel flow in pipe 24 is regulated by a modulating fuel valve 18 also controlled by the firing rate signal on path 14. It is typical that the relationship between air flow and fuel flow is fixed at each fuel flow rate, and controlled by a mechanical linkage between fan/damper 19 and valve 18. In a typical system, fuel flow is specified by the firing rate signal in terms of a percentage ratio of the maximum flow available. Because it is not possible to operate a typical burner system both efficiently and safely at very low firing rates, non-zero firing rate values will range between perhaps 20%, and maximum flow of 100%. The firing rate values may be taken to have 1% increments between some minimum value and 100%. It is also possible to use this invention with a step type of fuel rate control where valve 18 is either open or shut, or with multiple burners. In the latter case, special problems arise which will be briefly discussed below.

An on-off valve 22 provides redundant control of fuel flow to valve 18 through pipe 23 as supplied from a fuel source by pipe 25. Valve 22 has only open and shut states which are selected by first and second states respectively of the run signal carried on path 16. For purposes of understanding this invention, the run signal state specifying that valve 22 should be open may be considered to be a Boolean or logical 1 as far as the interpretation of it by the controller elements is concerned. This is shown in FIG. 1 by the legend "1=>RUN" on path 16. (The symbol "=>" has the meaning "implies" or "specifies" throughout FIGS. 1 and 2.) Of course, the standard operations involving starting and shutting down combustion also assure that fuel flow in pipe 24 does not start until a pilot flame or other ignition means is available within chamber 17. It is not meant in this description to ignore concerns relating to the safety of the burner system, but they are well known as are the solutions to them.

Hot gasses resulting from combustion within chamber 17 pass through a duct 26 to a heat exchanger 27 where heat is transferred from them through the walls of a duct 28 to a working fluid for use in the process for which the burner system is provided. The working fluid completely surrounds duct 28. Duct 28 also conducts these somewhat cooled combustion gasses to an exhaust flue or stack 30 from where they are vented to the atmosphere. FIG. 1 does not show a use of the heat which is derived from the duct 28, but the level of this use affects an operating condition of the working fluid within the heat exchanger 27 itself. Stack or flue temperature $T_c$ is measured by a temperature sensor 31 which provides on path 32 a temperature signal encoding the value of the flue temperature which is then placed in a microprocessor 10 operand memory location for access by elements shown in FIG. 1.

The heat exchanger 27 operating condition is measured by a operating condition sensor 35 which provides on path 36 an operating condition signal encoding a numeric value of the working fluid's operating condition within heat exchanger 27 which is available in an operand memory location. Typically, the operating condition of the heat exchanger 27 measured by sensor 35 is either temperature or pressure. The firing rate signal is varied so as to maintain the operating condition within heat exchanger 27 at or very near to a set point value.

Burner operation controller 11 executes the control functions needed to safely and efficiently operate the burner system, including the firing rate algorithm which controls the heat provided by the burner system. Monitor controller 10 comprises the elements forming the structure of the invention. In our preferred embodiment, controller 10 and controller 11 comprise separate microprocessors although as mentioned earlier, it is also possible to configure the control system as a single microprocessor. The program in controller 11 implements a condition control algorithm which constantly adjusts firing rate 14 as well as selecting the beginning and end points of run cycles when combustion actually occurs within chamber 27. A numeric set point is provided on a path 21 to controller 11 from an external source, typically the user. Path 21 will in this embodiment comprise one or more input ports of microprocessor 11 receiving signals from a keyboard or keypad not shown. While it is possible to change the set point in a typical installation, for the remaining discussion, the reader may assume that the set point does not change. There will be a brief discussion of the implications of a varying set point value at the end of this description.

A most important consideration in the operation-of the invention as practiced by the apparatus of claim 1, is burner system stability. The term is used here to mean essentially constant and unchanging operation of the burner system prior to a particular instant of time. We have developed some precisely defined requirements which must all be satisfied before the burner system is considered to have stability. These requirements are described in connection with the apparatus of FIG. 2, but for understanding the operation of FIG. 1, it is necessary at the present time to generally understand that stability means little change in firing rate, set point, and operating condition value for a period of time. The basis of the invention is that if these conditions are reproduced for a period of time, then the resulting flue temperature from the earlier and present time should also be reproduced if the operating status or efficiency of the burner system has not changed. For the time being, the reader should assume that stability exists for at least a brief period of time whenever a stability signal having a logical 1 value is provided by a stability detector 42 on signal path 54.

The stability detector 42 receives a clock signal on path 40 from a clock element 38 which has level transitions precisely one minute apart. This clock signal initiates operation of elements within detector 42 which determine whether a stable operation exists at that instant and if so sets the stability signal carried on path 54 to a logical 1 value. In the microprocessor embodiment here, it is customary to use a clock interrupt to transfer instruction execution to the stability detector instructions each minute. The instructions enabling the stability detector functions are executed and determine whether stability exists. If not, no further performance of the functions of this invention is necessary at the clock signal transition involved.

There are two different modes of operation of the apparatus of FIG. 1. The first in time occurs at the time the burner system has just been installed or just after an overhaul or cleaning, and is called hereafter the update mode. After the operations of the update mode are complete, the monitor system enters a test mode in which the operation of the burner system are frequently tested. In the update mode, flue temperatures are recorded as a function of firing rate whenever the stability condition is satisfied. In the test mode, the flue temperature is tested against the value previously recorded for the current firing rate whenever the stability condition is satisfied.

Update Mode

The start of the update mode is signalled to the system by a logical 1 value for a reset signal on path 56. The reset signal is provided by the human user in some way. In FIG. 1, the reset signal is shown as carried on a separate signal path which may be connected to a switch dedicated to providing the reset signal. It is equally possible to provide the reset signal by manipulation of the keyboard which provides externally generated data on path 21, in which case the reset signal will be issued by the operation controller 11 to the monitor controller 10. The reset signal should only be provided when the burner system is known to be operating at optimal efficiency. To reset the system at any other time will cause later operating status to be determined by reference to values representing less than optimal operation.

The reset signal's logical 1 value forms an input to the R (reset) input of a mode flip-flop 57, whose output is a temperature table valid signal provided by the "1" output terminal. The table valid signal has a logical 0 value during the update mode and is changed to a logical 1 by setting the mode flip-flop 57. Flip-flop 57 may comprise in a microprocessor embodiment a data byte set to zero to indicate the update mode and to a non-zero value to indicate the test mode.

The individual temperature values determined to accurately reflect optimal operating status during the update mode are stored in a temperature table memory 49 as a function of the current firing rate. This is symbolically shown by a number of individual memory locations, each of which corresponds to or is associated with one of the firing rates. (Recall that firing rates are discrete values ranging from some minimum value to 100%, or in certain cases only a single value.) Each memory location stores an individual temperature ($T_T$) entry 49*b* as well as an index (I) entry 49*a*, and is addressable with a firing rate value on a path 52. Table temperatures $T_T$ and index values I carried on path 51 are written into memory 49 with a write request signal comprising a write signal level on the read/write select (R/W SEL) path 50 and a firing rate value on path 52 specifying the memory location. That is, the firing rate value functions as a memory address for the temperature table memory 49. Similarly, a previously written temperature $T_T$ and index I can be retrieved with a read request signal comprising the firing rate encoded in the signal on path 52 and a read signal level on the read/write select (R/W SEL) path 50, with the specified table temperature $T_T$ and the index I encoded in the signal on path 53 as shown. When the reset signal is present (has its logical 1 value) on path 56, a clear (CLR) input to memory 49 is enabled, causing all of the index entries 49*a* and the temperature entries 49*b* to be cleared, i.e., set to zero.

During the update mode, the memory 49 cooperates with a temperature table manager 45 to prepare the memory 49 for the test mode by loading current temperature values from sensor 31 into the memory locations with which the firing rates are associated. An individual memory location can be updated only if the stability signal is a logical 1 and the table valid signal is a logical 0, and these conditions will be assumed during the rest of this paragraph. A series of related steps in the preferred embodiment update a single memory location. First, table manager 45 sets the read/write select signal on path 50 to the level specifying the read function and gates the current firing rate (carried on path 14) to path 52. The read select level on path 50 coupled with the firing rate value on path 52 causes the current values recorded in the index and temperature entries 49*a* and 49*b* specified by the firing rate to be read and gated on path 53 to manager 45. The current flue temperature $T_c$ on path 32 provided to manager 45 and is added by internal elements of manager 45 to the current table temperature $T_T$ on path 53. At the same time, the current index value from the location in memory 49 on path 53 and specified by the firing rate on paths 14 and 52 is incremented by one. Then a write level signal placed on path 50 and the current firing rate value on path 52 form a write request signal causing the newly formed table temperature and index entries encoded in the signal on path 51 to be stored in the memory location specified by the firing rate. Each time stability is detected and signalled by the stability signal on path 54, another temperature is entered into memory 49.

At some point it is necessary to end the update mode. There are a number of different criteria on which this event may be conditioned. One is a simple time limit, perhaps of hours, perhaps of days, and typically selected by the system operator, at the end of which the update mode ends. It is also possible to end the update mode once a certain number of the memory locations have one or more temperature values entered in them. In any case, a table status manager 48 receives signals on path 47 from the table manager 45 and/or from a timer 37 by which the update mode is terminated. Status manager 47 provides a logical 1 value to the S (set) input of the mode flip-flop 57 when the determination is made to enter the test mode. A preferred basis for the determination is to provide a table status signal on path 47 when a predetermined number of memory locations within memory 49 are non-zero. Then timer 37 also provides a test mode signal after a predetermined time period after the reset signal. Whichever of these two signals is received by status manager 48 first causes the logical 1 signal on path 55 which set mode flip-flop 57 to indicate the test mode. The reader should note that in many installations, even a few entries in temperature table memory 49 are adequate for testing the operating status of the burner system. This is because occurrence of those firing rates during update mode may frequently indicate a likelihood of those same firing rates during test mode. Secondly, it is not a life and death matter if an opportunity for testing operating status arises only occasionally. Perhaps a test as infrequently as once every several days or even a week or two is sufficient to detect inefficient operation of the burner system.

Once a determination to end the update mode has been made, then table manager 45 must make a series of calculations to prepare memory 49 for the test mode. This will be discussed in more detail in connection with FIG. 5, but basically, involves dividing each non-zero temperature entry in memory 49 with its associated index, and then replacing the temperature value with the quotient of this division operation. The reader will see that this forms the average of all of the flue temperature values recorded for the associated firing rate during the update mode. Of course, if the index value for a particular firing rate is one, there is no need for the division operation, and if zero, then no sample for that firing rate was ever recorded.

Test Mode

An individual test of burner system operation can only occur when test mode exists. An individual test is initiated when the stability signal changes from a logical 0 to a logical 1. Since conditions in a burner system are dynamic, stability may exist for literally only a few seconds. Our experimentation has shown, however, that this time is sufficient given the speed at which modern microprocessors operate, to allow an accurate determination of the operating status of the burner system before conditions change.

The actual signal which indicates operating status is provided by the "1" output of a operating status flip-flop 72. Since it is impossible to predict the state assumed by a flip-flop at power up, it is necessary to initially preset its value to indicate proper operating status. Accordingly, during update mode, the logical 0 table valid signal placed on path 55 by the mode flip-flop 57 is applied to an inverting input of an OR gate 63, creating a logical 1 output for OR gate 63 on path 66. The output of OR gate 63 is carried by a path 66 to the SET input of the status flip-flop 72 to thereby force the "1" output of flip-flop 72 to a logical 1 during the update mode. The reader should note that this is the exact hardware analog of the software condition where the state of the flag indicating operating status is considered to be unknown at the start of program execution. The prudent software designer includes code which sets this flag and all others as well to their desired initial values before actual processing of data begins.

For a test of operating status to occur, there are a number of conditions which must be satisfied simultaneously. Presence of these conditions is resolved by AND gates 62, 65, and 67. First, there must be a logical 1 on path 55 denoting test mode for the operating status detector. Secondly, there must be a logical 1 on path 54 denoting stability, about which there has been discussion above. Thirdly, there must be an entry in the temperature table memory for the current firing rate. Other conditions are also necessary but are detected during the determination of stability performed by detector 42 and to be discussed in connection with the detail of detector 42 in FIG. 2.

When a logical 1 signal appears on path 54 indicating stability of operation, the temperature table manager 45 responds by setting the read/write select signal on path 50 to its read value and gating the firing rate value carried in the signal on path 14 to path 52. This causes memory 49 to place the table temperature $T_T$ for that firing rate on path 53. The table temperature is tested by two different elements. Test element 69 tests the table temperature encoded on path 53 against 0 and if different from 0, sets a the signal on path 70 to a logical 1 as shown in FIG. 1. If the table temperature designated by the current firing rate is 0, is implies that stability was not detected during the update mode when the current firing rate existed, and therefore no opportunity exists to test operating status at the current firing rate. Test element 58 receives the current flue temperature encoded in the signal on path 32 and the table temperature encoded in the signal on path 53. These two values are compared, and if they are within a predetermined value of each other as symbolized by the "$\sim$" (approximately equal) operator, the signal on path 60 is set to a logical 1.

These foregoing operations in a microprocessor take literally only a few hundred μsecs. at most. A simple logic network comprising the OR and AND gates interprets the logic values to control the state of the operating status flip-flop 72. The table valid signal on path 55, the $T_T$ unequal to 0 signal on path 70, and the stability signal on path 54 are all applied to the three inputs of AND gate 62. If all of these signals have logical 1 values, they satisfy AND gate 62 and a logical 1 signal is provided on path 64. With a logical 1 on path 64, the actual test of operating status may be made.

Operating status is determined by the results of the test of $T_C \sim T_T$ and denoted by the logic level on path 60. The signal on path 60 forms a non-inverted input of AND gate 65 and an inverted input to AND gate 67. With a logical 1 value on path 60, one of the two outputs of AND gates 65 and 67 will have a logical 1 output. The output of AND gate 65 is applied to an input of OR gate 63. The reader should note that once the test mode exists, the signal on path 55 is a logical 1 and can no longer affect the signal provided by the output of OR gate 63. If AND gate 65 provides a logical 1 output, a logical 1 output will be present on path 66, causing the status flip-flop to set and its "1" output on path 75 to have its logical 1 value. This is interpreted by the user as indicating normal or efficient operation. On the other hand, if the output of test element 58 is a logical 0, this is applied on path 60 to the inverting input of AND gate 67, causing the signal level on path 71 to denote a logical 1. The output of AND gate 67 is applied on path 71 to the R or reset input of flip-flop 72, clearing it and setting its "1" output to a logical 0, denoting abnormal or inefficient operation. This state of flip-flop 72 may be the condition for turning on a warning light on a control panel, or may be indicated to a system operator on a display screen. Alternatively, a number of tests employing differing criteria for acceptable differences between the table temperature and the current temperature may be used, or the differences may be logged to determine a trend line.

Stability Detection

The details of the stability detector 42 as implemented in hardware are shown in FIG. 2. Elements appearing in both FIGS. 1 and 2 have the same reference numbers. The general approach of the apparatus of FIG. 2 in detecting stability sufficient to assure meaningful comparison over time of flue temperatures for a given firing rate is to require smaller changes in firing rate more recently than required earlier. In order to detect changes in firing rate over time, detector 42 includes a firing rate table memory 80 in which are recorded the 11 most recent firing rates. While the burner system controller 11 constantly changes the firing rate, the algorithm employed typically allows maximum change within any one minute interval of only a few percent. Furthermore, the maximum excursion in the firing rate within any one minute interval closely tracks the difference in the firing rate at the beginning and the end of the one minute interval. That is, it is very likely for most common loads that the firing rate within a one minute interval will fall outside the two endpoints only briefly and by only a small amount if at all.

A one minute clock element 38 controls updating of the firing rate table memory 80 and may be considered to issue logical 1 pulses starting precisely one minute apart as its output signal on path 40. Clock element 38 represents the instructions and hardware elements within controller 10 which implement the one minute interrupts for updating the firing rate table. The clock 38 signal is provided to a one-shot 77 whose output forms one input to an AND gate 123. One-shot 77 provides in response to the start of a clock pulse on path 40, a logical 1 output which has a duration somewhat longer than the time required for the various elements of FIG. 2 to complete their activities and provide a logical 1 input to AND gate 123. If the functions of FIG. 2 are implemented in hardware, perhaps several hundred milliseconds might be a suitable duration for one-shot 77. In a software implementation, the delay of one-shot 77 occurs implicitly in the sequential nature of instruction execution.

The clock pulses are used to update a firing rate table memory 80 in which are stored the 11 most recent firing rates sampled on the one minute clock intervals, with firing rate index values of zero through ten designating these 11 locations. The clock signal on path 40 is applied to a register 81 in which is maintained the firing rate table index. This index specifies which location of memory 80 should receive the newest firing rate value on path 14 from controller 10. The clock signal on path 40 is also applied to a delay element 82 which slightly delays the clock pulse on path 40 before applying it to an enable (EN) input of memory 80. The index in register 81 increments by one in response to each clock pulse, and counts module 11, so its values cycle from zero through ten and back to zero again through an 11 minute interval. The clock pulses on path 40 are delayed slightly by a delay element 82 to allow the index value in register 81 to be incremented by the clock pulse on path 78, and then is applied to an enable (EN) input of memory 80 to allow the newest firing rate to be stored in memory 80 in the location designated by the newly updated index value in register 81. The current index value in register 80 always designates the location holding the most recent firing rate except for the brief interval incorporated in delay 82. The timing function provided by delay 82 is typically inherent in the program implementing this apparatus in a microprocessor. However, to make the representation accurate this delay is included in the hardware diagram as well.

In FIG. 2, various of the firing rates stored in memory 80 are shown as being provided to three selector elements 90, 93, and 96. In a software implementation, the instructions will operate in a loop to sequentially access addresses of memory 80 to perform the selection and testing functions. In the hardware representation, signal path 86 is shown as carrying all 11 of the currently stored firing rate values to selector element 90. Selector element 90 tests each firing rate value supplied to it by memory 80 and extracts the largest and the smallest of these firing rates and places them on paths 98 and 99 respectively. Test element 107 forms the difference between the largest and smallest firing rate percentages and tests whether this difference is less than or equal to 25%. (Recall that firing rates are measured in percent of maximum firing rate.) If true, a signal level representing logical 1 is placed on path 110; a logical 0 is place on path 110 if untrue. The signal on path 110 forms one input to AND gate 123. In this way the firing rates at the start and end of the last ten one minute intervals are tested to determine whether the total change in firing rates has been greater than 25% over the last ten minutes. It is possible that there has been one or more excursions of the firing rate beyond the maximum and minimum values detected, but because of the characteristics of the firing rate algorithm, these excursions have been found to not affect the stability for purposes of the invention. If large changes are expected in the firing rate, then a larger firing rate table memory will be needed to assure that stability is accurately determined.

The six newest firing rates are provided to selector element 93 on path 85 by memory 80. Selector 93 performs the same type of selection procedure that selector 90 does, with the result that the largest and smallest firing rates sampled at the starts and ends of the last five one minute intervals are provided on paths 103 and 104 respectively to test element 108. Test element 108 senses whether the difference between these two firing rates is less than or equal to 10%, and if so sets the level on path 111 to provide a logical 1 to an input of AND gate 123. Thus, a logical 1 is present on path 111 if the maximum change in the firing rate over the last five minutes has been less than 10%, and a logical 0 otherwise.

In a similar manner memory 80 provides the three newest firing rates stored in it to test element 96 on path 84. If the three newest firing rates are exactly equal to each other then a logical 1 signal is place on path 112 and becomes another input to AND gate 123. A logical 0 is provided to AND gate 123 if the three newest firing rates are not all equal to each other.

It is also necessary that the newest firing rate stored in table 80 be unequal to zero, and this test is performed by element 88 which receives the current firing rate value on path 87. The output of element 88 on path 89 is a signal provided to AND gate 123 and having a logical 1 value if the newest firing rate is unequal to zero.

Another condition necessary for stability is that a run signal has been supplied to the burner system for at least ten minutes. In FIG. 2, this condition is sensed by a ten minute one-shot 116 and an AND gate 118. In the software implementation, an interrupt based on the real time clock of controller 10 will provide the function of one-shot 116. The run signal has a logical 1 level when the burner is in run mode. Whenever the run signal changes from a logical 0 to a logical 1, the output of one-shot 116 is held at a logical 1 for the ten minute period following. A logical 1 on the inverting input disables the AND gate 118 causing a logical 0 on path 113 which is applied to an input of AND gate 123. One can see that the output of AND gate 118 remains a logical 0 until ten minutes after the run signal on path 16 changes from logical 0 to logical 1, and in any case becomes a logical 0 if the run signal has a logical 0 level. Therefore, the output of AND gate 123 cannot become a logical 1 indicating stability until at least ten uninterrupted minutes of the run mode have elapsed.

It is also necessary for stability that the operating condition as measured by sensor 35 be within a predetermined range centered on the set point value encoded in the signal on path 15. A test element 120 tests that the operating condition value is approximately equal to the set point value as indicated by the "~" symbol. If the operating parameter measured by sensor 35 is pressure in a steam generating burner system, a deviation from the set point of 1 psi. will usually be acceptable. If the operating parameter is temperature in a hot water system, a deviation from the set point of 5° F. might be selected. At any rate, when the operating condition and set point values are approximately equal, a logical 1 level is provided on path 114 to AND gate 123, and if these values are not approximately, a logical 0 is provided to AND gate 123 on path 114.

It can be seen from the preceding discussion that seven different conditions must all be simultaneously present to allow AND gate 123 to provide a logical 1 level on path 54 denoting a stable condition of the burner system.

In one preferred embodiment, this detector apparatus has been adapted for use with a burner system having a number of different operating condition levels, or set points. This situation can be accommodated by providing a number of different temperature tables in memory 42, one for each operating condition. This variation is relatively easy to implement, and will not be described in detail.

Software Representation

FIGS. 3–7 are software flowcharts defining a program which transforms a computer or microprocessor, when loaded into its program memory, into the hardware configuration of FIGS. 1 and 2. The various elements, signals, and data paths described in connection with FIGS. 1 and 2 exist within the microprocessor during the time that instructions replicating the functions involving these individual elements and activities as is well known by those familiar with the operation of microprocessors.

The ability of the individual software modules to access external data and flags (signal bits) through the microprocessor's input channels and provide flags and data to external users through output channels as explained in connection with FIG. 1 is assumed. In the software implementation contemplated here, instruction execution is transferred from a scheduler shown in FIG. 3 to the individual software function modules of FIGS. 4–7 which perform the overall system process. The symbols used in FIGS. 3–7 to indicate the various types of functions follow common practice. The small circles such as that designated 140 are connector elements indicating either the start of a group of instructions to which the scheduler branches, or the end of a group of instructions from which a branch to the scheduler occurs. Rectangles such as at 144 are activity elements indicating actions, which may include inherent decision functions. Horizontally elongated hexagons as at 142 with two paths emanating therefrom are decision elements, with labels indicating the path taken for each state of the condition tested.

Scheduler

Figure 3:
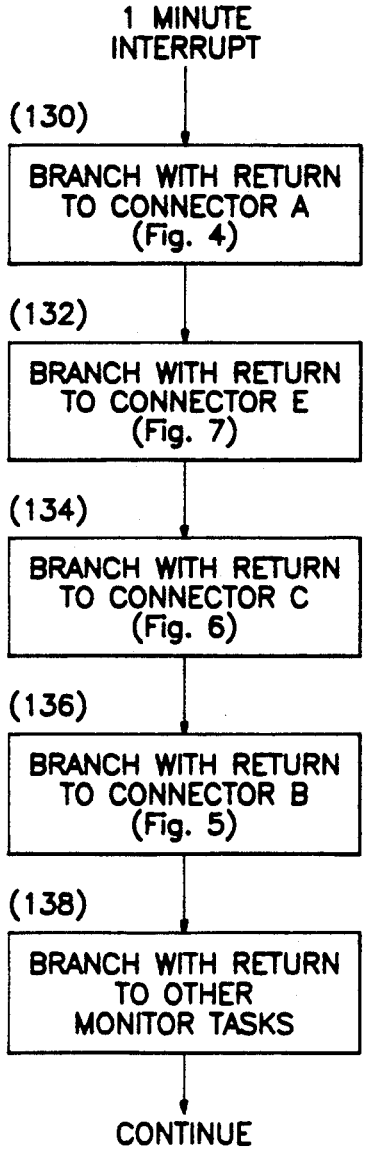

The scheduler shown in FIG. 3 includes a number of branch instructions for transferring instruction execution to various software modules to be discussed and then receiving control back from them through their exit connectors 139. The portion of the scheduler shown is executed each minute when an interrupt transfers instruction execution to activity element 130. Element 130 causes the setup instructions of FIG. 4 to be executed. After the instructions of FIG. 4 have been executed, the return occurs and the instructions of activity element 132 are executed. These transfer execution to the instructions symbolized by the elements of FIG. 7 which update the firing rate table. Execution again returns to the scheduler at activity element 134 after the instructions of FIG. 7 have been executed. Element 134 provides for a branch to execute the instructions of FIG. 6 for testing stability of burner operation. The return to the instructions of FIG. 3 next causes the instructions of FIG. 5 to be executed by which the temperature table is updated if in update mode, or the operating status is tested, if in test mode. The FIG. 5 instructions, when completed, return control to the scheduler in order to next execute other monitor controller instructions, not shown. Eventually another one minute interrupt occurs and execution of instructions again starts with activity element 130.

Setup

Figure 4:
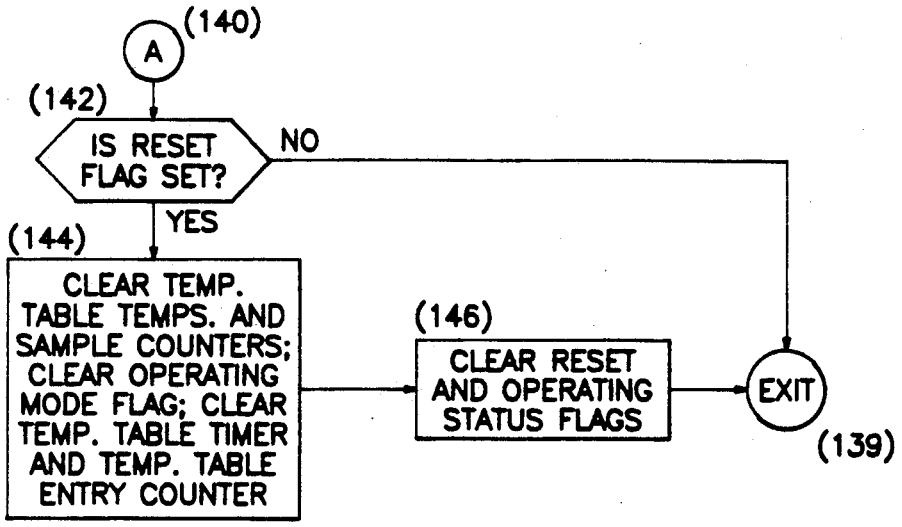
FIGS. 3–7 are software flowcharts defining a number of instruction modules to be executed in a microprocessor for implementing the functions shown in FIGS. 1 and 2.

When the instructions of element 130 are executed, control is transferred through connector A 140 to the instructions of a decision element 142 in FIG. 4. The instructions of FIG. 4 perform the preliminary activities necessary to prepare the microprocessor for the update mode. A reset flag having two states, set or cleared, i.e. nonzero or zero, is stored in the operand memory of the microprocessor and usually can be set by the operator of the burner system either through a keyboard input or through a separate control switch provided for the purpose of setting the reset flag. When the reset flag is set, the instructions of decision element 142 cause the instructions of activity element 144 to be executed. The activity element 144 instructions clear temperature and sample counter entries of a temperature table analogous to memory 42 of FIG. 1, clear an operating mode flag analogous to the mode flip-flop 57, clear an operand location containing a temperature table timer value analogous to the table status timer 37 of FIG. 1, and clear a temperature table entry counter. Individual entries in the temperature table are available by use of a table index which is equal to the firing rate plus some base constant value according to well known principles of computer memory organization. The temperature table entry counter records the number of nonzero temperature table entries. The instructions of activity element 146 then cause the reset flag and the operating status flag to each be cleared. Each of these variable elements comprise one or more memory locations within the operand memory of the microprocessor. Instruction processing is then transferred back to the scheduler as indicated by the exit connector element 139.

Firing Rate Table

Figure 7:
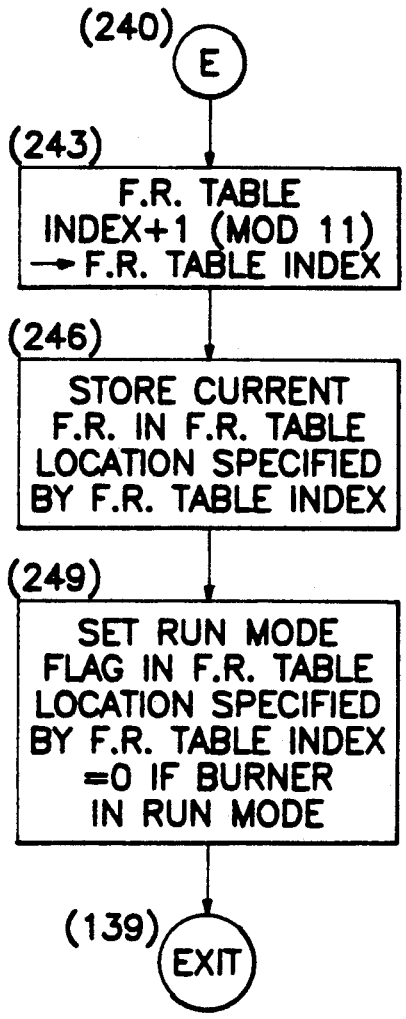

At each one minute interrupt and after the setup instructions of FIG. 4 have been executed, a branch with return to connector E 240 designated by the instruction of activity element 132 (FIG. 3) occurs, causing execution of the instructions of FIG. 7. The instructions of activity element 243 cause a firing rate table index to be incremented by one. This entails adding one, module 11, to the current value of the firing rate table index. By this is meant that when one is added to ten, the result is zero rather than 11. Thus the firing rate table index is always an integer in the range of zero through ten inclusive.

Next the instructions of activity element 249 cause a current run mode flag and the current firing rate to be loaded into the firing rate table location specified by the firing rate table index. This overwrites the old firing rate with the new firing rate just determined. Element 249 also updates the run mode flag in the firing rate table entry specified by the firing rate table index by setting the run mode flag equal to 0 if the burner is in run mode.

Software Stability Sensing

Figure 6:
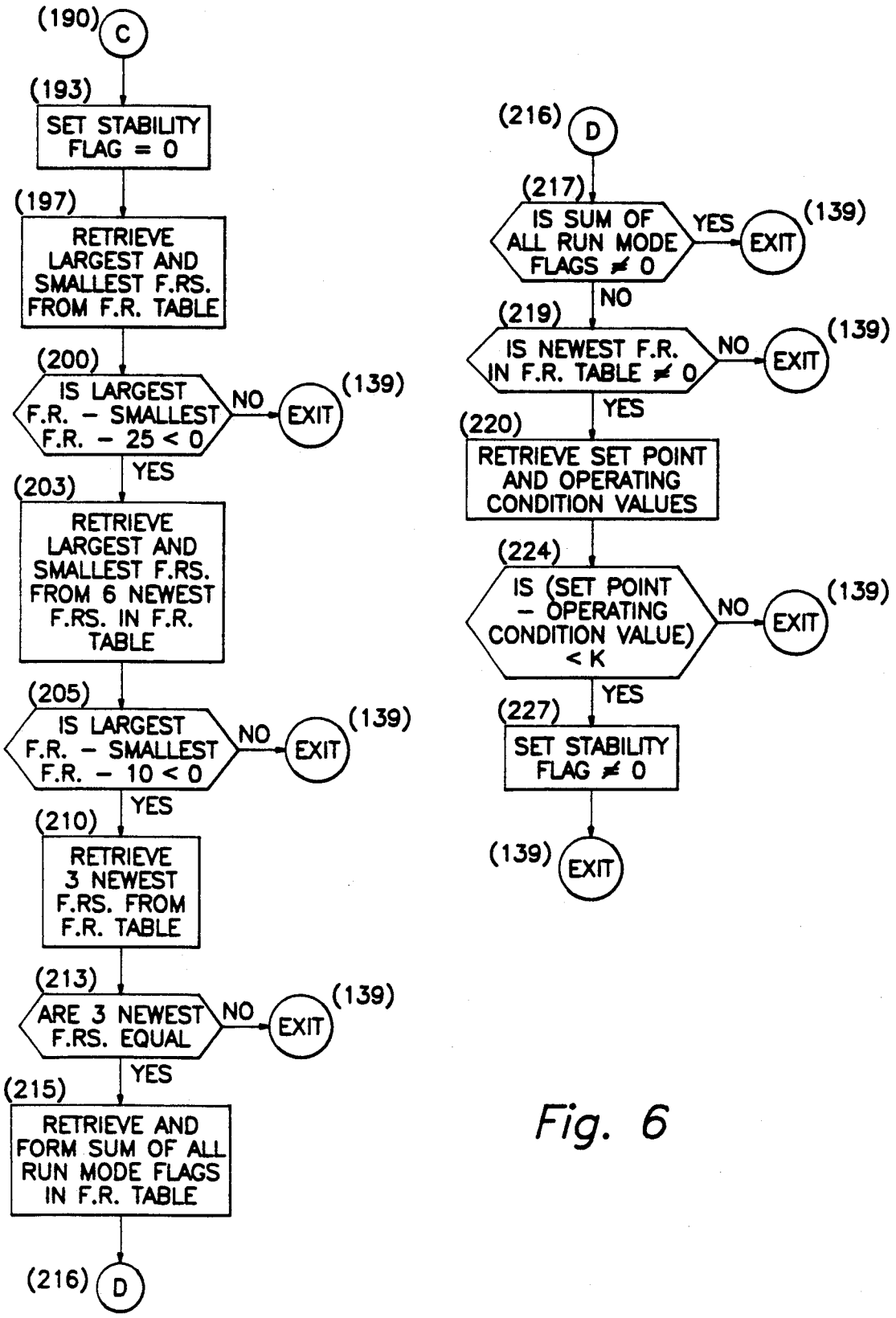

After the firing rate table has been updated by the instruction of FIG. 7, the return to FIG. 3 and activity element 134 occurs. Element 134 transfers execution of the instructions symbolized by the elements of FIG. 6 in order to determine whether the burner system operation is stable. FIG. 6 is the software analog of the hardware configuration shown in FIG. 2 and in fact, the individual microprocessor actions defined by the software elements of FIG. 6 closely track the hardware elements of FIG. 2. As mentioned in connection with FIG. 2, there are a number of conditions which must be satisfied for stability to exist. Several are based on the history of the firing rate. As was explained in connection with FIG. 2, if changes in the firing rate are too large within a certain interval preceding the current time then stability does not exist. Therefore, it is necessary to record the firing rate history for a period of time. This is done in a firing rate table (analogous to the firing rate table memory 80 of FIG. 2) held in the operand memory (RAM) of the microprocessor implementing the invention as well as controlling operation of the burner system. In the preferred embodiment, changes in firing rates occurring previous to ten minutes earlier than the current time are deemed to have negligible effect on the current flue temperature. Accordingly, an 11 entry firing rate table is maintained in preselected consecutively addressed locations in the operand memory. An integer firing rate table index whose value varies between zero and ten inclusive and which sequentially designates each of these 11 entries to be overwritten by the current firing rate at one minute intervals, is also kept in an operand memory location. It can be seen that access to a particular firing rate table entry can be specified by the firing rate index.

As noted above, firing rates change at intervals much more frequent than one minute, yet the changes are slow enough in the preferred firing rate algorithm so that samples at one minute intervals are adequate to accurately reflect stability in the firing rate for purposes of this invention. After transfer of instruction execution to connector C 190, the first action, performed by the instructions of activity element 193, is to clear the contents of the register containing the stability flag. If the stability flag is equal to zero, as discussed in connection with decision element 152 of FIG. 5, this indicates that burner system operation has not been stable according to the definition of the invention.

Execution of the instructions of activity element 197 then immediately follows. At this time, the firing rate table contains all of the firing rate values which were sampled on the last 11 one minute interrupts. The ten consecutive pairs of the firing rate values define start and end firing rates for ten one minute periods. Activity element 197 represents instructions which retrieve the largest and smallest firing rate values from the firing rate table. This can be accomplished by a single pass through all ten entries of the firing rate table, starting anywhere in it and comparing the size of each firing rate as it is retrieved to the largest and smallest firing rates previously retrieved and stored respectively in a largest firing rate register and a smallest firing rate register. If a new largest or smallest is found, then this value replaces the current largest or smallest in its respective register. After all 11 firing rate entries in the table have been examined in this way, the largest and smallest values in the table will have been found and are held in the largest firing rate register and the smallest firing rate register. Execution of these instructions is the equivalent of the actions taken by element 90 of FIG. 2. Decision element 200 subtracts the smallest firing rate and 25 from the largest firing rate and compares this difference to zero. If this value is greater than or equal to zero, by definition stability does not exist and the standard exit back to the scheduler is taken through the exit connector 139. If this value is less than zero, stability may exist, and operation proceeds to the next test.

In this next test, the six newest firing rate values are examined, and the largest and smallest from this group are retrieved by an algorithm identical to that used to find the largest and smallest of all 11 firing rates. Note that the current value of the firing rate table index must be used to define the newest firing rate. The newest firing rate index may then be stored in a working operand location where it is decremented by one, module 11, five times, to define the five other of the six newest firing rates. Again the largest and smallest firing rates are stored in the largest firing rate register and the smallest firing rate register. Once the largest and the smallest of the newest six firing rates have been retrieved, the operations of decision element 205 is performed. In this element, the largest firing rate less the smallest firing rate less ten is computed and the result of this computation is compared to zero. If greater than or equal to zero the standard exit to the scheduler occurs. If less than zero, then another step in determining stability has been passed and instruction execution proceeds to the next element indicated.

Activity element 210 indicates retrieval of the three newest firing rate values from the firing rate table. Again it should be noted that the firing rate table index must be used to identify the three firing rate table locations storing these three values. If the three newest firing rate values are not all equal to each other, again no stability exists, and the exit to the scheduler is taken through connector 139. If the three newest firing rates are equal to each other, then there has been no change in firing rate for two full minutes and the system may be tested for another stability condition.

The reader should note that these three firing rate-based tests for stability are only one particular and somewhat arbitrary set of which there may be others more suitable in different situations. For example, fewer than three tests may be sufficient in some circumstances, and the time limits and range between largest and smallest firing rates may be varied.

It is also necessary to determine whether the system has been in run mode for the last ten minutes. While there are a number of different algorithms which may be used to determine this condition, the procedure disclosed here is to provide a second value recorded with each firing rate. This value has either a zero or nonzero value, typically one, and each minute at the same time the new firing rate value is stored, is set to zero if the run mode exists, and to one if the run mode does not exist. The sense of the run mode flag is thus inverted from that of the run signal carried on path 16 as shown in FIG. 1. All of the run mode flag settings for the last ten minutes are retrieved from the firing rate table and summed together, as indicated by the activity element 215. Instruction execution continues through connector D 216 with the instructions of decision element 217 which test whether the sum of the run mode flags is unequal to zero. If so, this means that at least briefly during the last ten minutes, the burner system was not in run mode and in this case also fails the test for stability, leading to an exit to the scheduler. If the sum of the run mode flags equals zero, then the run mode has existed continuously for at least ten minutes, and another criterion for stability may be tested.

The instructions of decision element 219 are the software equivalent of one-shot 116 and AND gate 118 shown in FIG. 2. Decision element 219 tests the newest firing rate in the firing rate table to be unequal to zero and returns to the scheduler if this condition is not satisfied. This test corresponds to element 88 of FIG. 2. It is necessary to assure that the firing rate is unequal to zero, since it is possible to pass all of the previous tests with a firing rate of zero, yet no worthwhile test of burner operation is available in this state.

Activity element 220, performed next, symbolizes instructions which retrieve the set point and operating condition values from their locations within the operand memory of the microprocessor. If the difference between them is less than a predetermined value shown as K in decision element 224, then the last of the various criteria for stability has been satisfied and instruction execution continues with activity element 227. If the difference between the set point and the operating condition values is greater than or equal to K, then execution of instructions passes to the scheduler via exit connector 139. K may be selected with a value as necessary to assure accurate sensing of stability status without sensing stability too frequently or not frequently enough.

Figure 5:
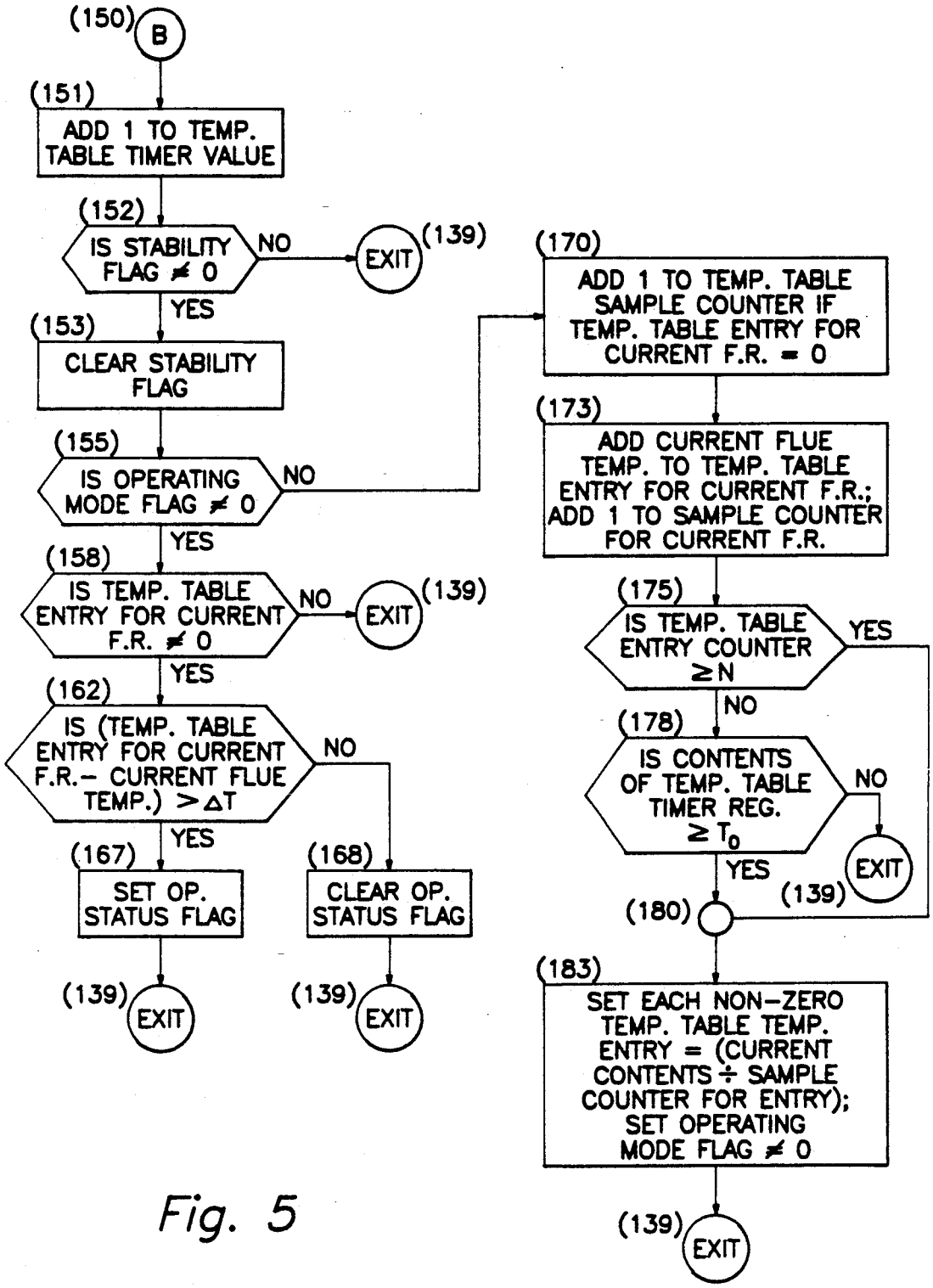

Activity element 227 instructions set the stability flag unequal to zero which indicates stable conditions of the burner system, and will allow the instructions symbolized by the elements of FIG. 5 to either update the temperature table or to test the stability status, depending on the operating mode which currently exists.

Software Update and Test Modes

After stability has been tested and the return to FIG. 3 has occurred, the instructions symbolized by the elements of FIG. 5 are next executed and replicate the main functions of FIG. 1. The functions of the temperature table manager 45 and the table status manager 48 of FIG. 1 are spread throughout FIG. 5. After testing for stability has occurred, the scheduler transfers instruction execution to the instructions starting with connector B 150. The temperature table timer, initially cleared by the instructions of element 134 in FIG. 3, are incremented by 1 by the instructions corresponding to activity element 151. It will thus be seen that at any given time the contents of the temperature table timer equals the number of minutes that the stability status detection system has been active since the last reset signal.

Then the instructions of decision element 152 test the stability flag set by the execution of instructions represented by FIG. 5. If the stability flag is equal to 0 (cleared), the instructions of element 152 cause instruction execution to branch back to the scheduler through exit connector 139. If the stability flag is unequal to 0 (set) then instruction execution continues with the instructions represented by activity element 153, which cause the stability flag to be cleared.

Instruction execution then continues with the instructions of decision element 155 which test the operating mode flag to be set, i.e. nonzero. The operating mode flag in this software embodiment is the exact analog of the mode flip-flop 57 and its temperature table valid signal on path 55. The operating mode flag, as with the stability flag, is maintained in a location of the microprocessor 10 operand memory and thus may be thought of as simulating an actual hardware flip-flop such as flip-flop 57. If the operating mode flag is nonzero, the next instructions to be executed are those represented by decision element 158 and the following elements, which execute the steps of the test mode. These instructions duplicate the functions of elements 58, 69, the various logic gates controlling the inputs to flip-flop 72, and flip-flop 72 itself, in FIG. 1. If the operating mode flag equals zero, then instruction execution transfers to the instructions of activity element 173 to perform the instructions relating to the update mode.

Since the update mode always precedes the test mode, it is convenient to first consider the actions of element 170 and the instructions which follow it. It is necessary to terminate the updating of the temperature table at some point before burner system performance begins to deteriorate significantly. Each firing rate entry in the temperature table includes a sample counter containing the number of nonzero temperature samples which have been logged for the current firing rate. Initially, every sample counter is set to zero by the instruction of activity element 144 (FIG. 4). Activity element 173 symbolizes instructions which add the current flue temperature, which is available in a location of the operand memory as discussed above, to the value currently recorded in the temperature table entry specified by the current firing rate. Element 173 also includes instructions to increment both the sample counter recorded in the temperature table location specified by the current firing rate and the temperature table timer register by 1.

The instructions symbolized by decision element 175 cause the microprocessor 10 to test whether the temperature table entry counter, which contains the number of temperature table entries which hold at least one flue temperature sample, is greater than or equal to a preselected constant N. When the value of that counter reaches some preselected value, say N =60 for 81 different firing rates (20% to 100% by 1% increments), then the condition for which decision element 175 tests has occurred and the "YES" path to connector 180 is taken. The actual value of N may be set by the user as a specification to the manufacturer or there may be a provision for the user to set this value during installation. N ideally should equal more that perhaps 75% of the total number of possible firing rates. On the other hand, the update mode should not be extended for too long a time because the burner system operating status will constantly fall little by little during use.

Because it is not easy to predict what success there will be in filling the temperature table during the update mode, it is preferable to include a time limit on updating the temperature table. The temperature table timer register contains the number of minutes which have elapsed since the last reset signal occurred. The instructions of element 178 test the contents the temperature timer register to be greater than or equal to a preselected time constant $T_o$. If this condition is true, then instruction execution continues with the instructions at connector 180. If false, the instructions for decision element 175 cause a branch to the scheduler, as shown by the "NO" path to exit connector 139. The value chosen for time constant $T_o$ is entirely analogous to the time constant of timer 37 in FIG. 1.

The instruction of activity element 183 complete processing of the values currently recorded in the temperature table memory to prepare them for the test operating mode. Each nonzero temperature entry in the temperature table is divided by its value recorded in its sample counter and this quotient replaces its dividend in the temperature table, in this way forming the average of all flue temperatures sampled for a given firing rate during stable conditions. The instructions of element 183 further set the operating mode flag to a nonzero value which places the stability status system into test mode, and then instruction execution exits via connector 139 to the scheduler.

Once the operating mode flag has been set unequal to zero, the control system is operating in test mode, and branches from the instructions of decision element 155 are to decision element 158, which determines whether a temperature value exists in the temperature table for the current firing rate. That is, element 158 determines whether during the preceding update mode there was at least one occasion where the current firing rate occurred and there was stable operation. If not, no determination of operating status can be made and instruction execution is transferred yet again to the scheduler.

If there is an entry in the temperature table for the current firing rate, then the actual test of operating status is performed by the instructions of decision element 162. The entry in the temperature table for the current firing rate is retrieved and its difference from the current flue temperature is calculated. If the absolute value of this difference is less than or equal to a predetermined value ▒T then an operating status flag is cleared by the instructions of activity element 168. If the absolute value of this difference is greater than ▒T then an operating status flag is set to a nonzero value. In each case, operation then returns to the scheduler and the instruction to set the firing rate for the next minute are executed as indicated by activity element 136.

Since operation of these burner systems is always somewhat variable because of conditions not possible to control, requiring precise equality (▒T=0) for proper operation would result in too frequent sensing of improper operating status. For example, ambient air temperature, barometric pressure, or humidity, or the current ratio of the constituents of the fuel in use all can affect the flue temperature slightly even though other conditions are close to the conditions existing at the time the entry or entries in the temperature table were made during the update mode. It is also likely that the performance will have deteriorated slightly since the entries were made in the temperature table, but not to an extent which makes further operation uneconomic without maintenance. Such deterioration may cause a detectable change in the flue temperature relative to the corresponding temperature table entry, and as such could be logged as indicating the need for maintenance action at some time in the future. Perhaps in some systems, the actual value of the difference between $T_T$ and $T_C$ can be tracked, and a trend line established to determine a suitable point at which to perform maintenance.

What we wish to claim is:

1. Apparatus for signaling operating status for a burner system including a controller receiving a set point signal encoding a set point value for burner system operation and issuing a firing rate signal encoding a firing rate having a value dependent on the set point signal, a combustion chamber, a modulating fuel valve controlling flow rate of fuel to the combustion chamber responsive to the firing rate signal, a heat exchanger, and an exhaust flue in flow communication with the combustion chamber and through which pass combustion gasses from the combustion chamber, comprising:

a) a temperature sensor mounted within the exhaust flue and providing a flue temperature signal encoding the temperature of combustion gasses within the exhaust flue;

b) timer means for providing a first timing signal defining the beginning and end points of a plurality of first time intervals;

c) stability detector means receiving the firing rate signal and the first timing signal, for providing a stability signal having a first state responsive to a change of less than a predetermined amount in the firing rate between the beginning and end points of a first time interval and a second state otherwise;

d) a temperature table memory recording a plurality of flue temperature values each recorded in association with a specified firing rate value, and providing a memory output signal encoding the flue temperature value recorded in association with a firing rate value responsive to a read request signal encoding that firing rate value;

e) table manager means receiving the firing rate signal, and supplying to the temperature table memory a read request signal encoding the firing rate encoded in the received firing rate signal, for causing the temperature table memory to issue a memory output signal encoding the entry associated with the firing rate encoded in the read request signal;

f) temperature comparison means receiving the flue temperature signal from the temperature sensor and the memory output signal from the temperature table memory, for forming the difference between the temperatures encoded in the flue temperature signal and the memory output signal, and for supplying a comparison signal having a first state responsive to the difference between the temperatures being more than a predetermined amount and a second state otherwise; and g) operation analysis means receiving the stability signal and the comparison signal, for responsive to the first state of the stability signal and the first state of the comparison signal, providing an operating status signal having a first state, and an operating status signal having a second state otherwise.

2. The apparatus of claim 1, wherein the timer means includes means for issuing a plurality of second timing signals between the beginning and end points of a first time interval signal, and wherein the stability detector means includes a) firing rate table means receiving the second timing signals and recording the current firing rate value as each second timing signal is received, and providing a plurality of firing rate values recorded between a beginning and end point signal of the first time interval encoded in a firing rate table signal; and b) firing rate testing means receiving the firing rate table signal from the firing rate table means, for forming the difference between the largest and smallest firing rates encoded in the firing rate table signal, and for comparing said difference with a preselected first constant value, and if smaller than the constant value, providing the stability signal with its first state, and providing the stability signal with its second state otherwise.

3. The apparatus of claim 2, wherein the timing means includes means for issuing first and second first timing signals each having different beginning points and substantially simultaneous end points; wherein the firing rate table means includes means for issuing first and second firing rate table signals respectively for the first and second first timing signals, and wherein the firing rate testing means includes means receiving the first and second firing rate table signals and forming a difference between the largest and smallest firing rate values for each of the first and second first time intervals, and for issuing the stability signal with its first state responsive to the differences derived from each of the first and second firing rate table signals being less than first and second preselected constant values, and the stability signal with its second state otherwise.

4. The apparatus of claim 2, wherein the burner system includes a fuel on-off valve controlling flow of fuel to the combustion chamber and opening and closing responsive respectively to the first and second states of a run signal, and an operating condition sensor in sensing relationship with the heat exchanger and issuing an operating condition signal indicative of an operating parameter of the heat exchanger and wherein the controller issues the run signal and a set point signal encoding a preselected operating set point, wherein the firing rate testing means further includes means receiving at least either the operating condition and set point signals or the run signal for basing the first state of the stability signal on at least one of the conditions of the operating condition signal approximately equaling the set point signal and the run signal having its first state.

5. The apparatus of claim 2, wherein the burner system includes a fuel on-off valve controlling flow of fuel to the combustion chamber and opening and closing responsive respectively to the first and second states of a run signal, and an operating condition sensor in sensing relationship with the heat exchanger and issuing an operating condition signal indicative of an operating parameter of the heat exchanger and wherein the controller issues the run signal and a set point signal encoding a preselected operating set point, wherein the firing rate testing means further includes means receiving at least either the operating condition and set point signals or the run signal for basing the first state of the stability signal on both of the conditions of the operating condition signal approximately equaling the set point signal and the run signal having its first state.

6. The apparatus of claim 2, wherein the temperature table memory includes memory update means receiving a write request signal encoding a firing rate and the flue temperature signal for causing the temperature table memory to record in association with the firing rate encoded in the write request signal, the flue temperature encoded in the flue temperature signal; and wherein the table manager means includes means receiving the stability signal and the flue temperature signal, and responsive to the first state of the stability signal issuing a write request signal encoding the firing rate value encoded in the current firing rate signal to thereby cause the memory to record the flue temperature value encoded in the flue temperature signal.

7. The apparatus of claim 6, further including: a table status flip-flop and providing a table valid signal having first and second states, said table status flip-flop providing the first state of the table valid signal responsive to a ready signal and the second state of the table valid signal responsive to an externally supplied reset signal; a table status manager means receiving a table status signal from the temperature table manager means, for issuing the ready signal to the table status flip-flop responsive to a predetermined state of the table status signal; and wherein the temperature table manager means further includes means for issuing the table status signal encoding a value depending on a predetermined condition of the temperature table memory.

8. The apparatus of claim 7, wherein the temperature table memory includes means responsive to the reset signal for clearing the temperature values in the memory.

9. The apparatus of claim 8, wherein the timer means includes means receiving the reset signal for issuing a table status timing signal a predetermined time after the reset signal occurs, and wherein the table status manager means includes means receiving the table status timing signal and issuing the ready signal to the table status flip-flop responsive to the table status signal.

10. The apparatus of claim 8, wherein the temperature table memory includes means for recording an entry index associated with each firing rate value, and for clearing all entry indices responsive to the reset signal, and wherein the memory update means includes i) means receiving the current firing rate signal for adding the flue temperature encoded in the current flue temperature signal to the temperature value recorded in the temperature table memory in association with the firing rate encoded in the current firing rate signal, and incrementing by one the entry index associated with the firing rate encoded in the current firing rate signal, all responsive to a stability signal, and ii) means receiving the table valid signal, for replacing each non-zero temperature value recorded in the temperature table memory with the quotient of the temperature value divided by the associated index, responsive to a change in the table valid signal from its second to its first state.

11. The apparatus of claim 7, wherein the temperature table manager means includes means for issuing the table status signal with the predetermined state responsive to at least a predetermined number of non-zero temperature values in the temperature table memory.

12. A method for signaling operating status for a burner system including a controller receiving a set point signal encoding a set point value for burner system operation and issuing a firing rate signal encoding a firing rate having a value dependent on the set point signal, a combustion chamber, a modulating fuel valve controlling flow rate of fuel to the combustion chamber responsive to the firing rate signal, a heat exchanger, and an exhaust flue in flow communication with the combustion chamber and through which pass combustion gasses from the combustion chamber, comprising:

a) sensing the temperature within the exhaust flue and providing a flue temperature signal encoding the temperature of combustion gasses within the exhaust flue;

b) providing a first timing signal defining the beginning and end points of a plurality of first time intervals;

c) receiving the firing rate signal and the first timing signal, and providing a stability signal having a first state responsive to a change of less than a predetermined amount in the firing rate between the beginning and end points of a first time interval and a second state otherwise;

d) recording in a temperature table memory a plurality of flue temperature values each recorded in association with a specified firing rate value, and providing a memory output signal encoding the flue temperature value recorded in association with a firing rate value responsive to a read request signal encoding that firing rate value;

e) receiving the firing rate signal, and supplying to the temperature table memory a read request signal encoding the firing rate encoded in the received firing rate signal, for causing the temperature table memory to issue a memory output signal encoding the entry associated with the firing rate encoded in the read request signal;

f) receiving the flue temperature signal from the temperature sensor and the memory output signal from the temperature table memory, forming the difference between the temperatures encoded in the flue temperature signal and the memory output signal, and supplying a comparison signal having a first state responsive to the difference between the temperatures being more than a predetermined amount and a second state otherwise; and g) receiving the stability signal and the comparison signal, for responsive to the first state of the stability signal and the first state of the comparison signal, providing an operating status signal having a first state, and an operating status signal having a second state otherwise.

13. A method for signaling the operating status of a burner system including a controller receiving a set point signal and issuing a firing rate signal responsive to the burner control signal, a combustion chamber, a modulating fuel valve controlling flow rate of fuel to the combustion chamber responsive to the firing rate signal, a heat exchanger, and an exhaust flue in communication with the combustion chamber and through which pass combustion gasses from the combustion chamber, comprising:

a) mounting a thermometer within the exhaust flue providing a flue temperature signal encoding the temperature of combustion gasses within the exhaust flue;

b) providing a first time interval signal defining a plurality of first time intervals;

c) providing at the start of a first time interval a stability signal having a first state responsive to a change of less than a predetermined amount in the firing rate during the preceding first time interval and a second state otherwise;

d) providing an operating mode signal having a first state for a period of time and a second state thereafter;

e) recording in association with the firing rate value, the flue temperature value currently existing at the occurrence of each of a plurality of the first state of the stability signal and issuing encoded in a memory output signal responsive to a request signal encoding a firing rate value, the flue temperature value previously recorded in association with said firing rate value; and f) during the second state of the operating mode signal providing a request signal encoding the current firing rate value and receiving a memory output signal encoding a flue temperature value associated with the current firing rate, comparing the flue temperature value encoded in the memory output signal with the flue temperature encoded in the flue temperature signal, and when the stability signal has its first state, providing an operation status signal having a value dependent on the difference between the flue temperature value encoded in the memory output signal and the flue temperature value encoded in the flue temperature signal.

14. The method of claim 13, wherein the recording step includes the step of conditioning the recording of a flue temperature value on the existence of the first state of the operating mode signal.

15. The method of claim 13, including the step of providing the operating mode signal with its first state when the number of flue temperature values recorded is less than a preselected number.

16. The method of claim 13, including the steps of recording a plurality of firing rate values at preselected consecutive intervals, and calculating the difference between the largest and smallest recorded firing rate values and issuing the stability signal with its second state responsive to the difference between the largest and smallest recorded firing rate values exceeding a preselected difference value, and the stability signal with its first state otherwise.

17. The method of claim 16, wherein the step of issuing a stability signal includes the step of conditioning the first state of the stability signal on the current firing rate signal encoding a nonzero firing rate for a predetermined duration.

18. The method of claim 13, to be applied to a burner system including a boiler to which heat is transferred from the combustion chamber and includes an operating pressure sensor providing a pressure signal encoding the boiler pressure value, and wherein the set point signal encodes a pressure value, wherein the step of providing the stability signal further includes the step of issuing a stability signal having the first state responsive to the pressure signal falling within a predetermined range including the set point signal's pressure value, and a stability signal having the second state otherwise.

19. The method of claim 13, to be applied to a burner system including a boiler to which heat is transferred from the combustion chamber and includes an operating temperature sensor providing a temperature signal encoding the boiler temperature, and wherein the set point signal encodes a temperature value, wherein the step of providing the stability signal further includes the step of issuing a stability signal having the first state responsive to the temperature signal falling within a predetermined range including the set point signal's temperature value, and a stability signal having the second state otherwise.

* * * * *